US010016058B2

(12) United States Patent
Adams et al.

(10) Patent No.: US 10,016,058 B2
(45) Date of Patent: Jul. 10, 2018

(54) FOOT FOR MOLDED PLASTIC FURNITURE

(71) Applicant: Adams Mfg. Corp., Portersville, PA (US)

(72) Inventors: William E. Adams, Portersville, PA (US); William E. Adams, IV, Zelienople, PA (US)

(73) Assignee: Adams Mfg. Corp., Portersville, PA (US)

( * ) Notice: Subject to any disclaimer, the term of this patent is extended or adjusted under 35 U.S.C. 154(b) by 352 days.

(21) Appl. No.: 14/842,114

(22) Filed: Sep. 1, 2015

(65) Prior Publication Data

US 2015/0366347 A1 Dec. 24, 2015

Related U.S. Application Data

(63) Continuation of application No. 13/334,197, filed on Dec. 22, 2011, now Pat. No. 9,144,309.

(51) Int. Cl.

| | |
|---|---|
| ***B23P 11/02*** | (2006.01) |
| ***F16M 11/20*** | (2006.01) |
| ***A47B 91/12*** | (2006.01) |
| ***A47B 91/02*** | (2006.01) |
| ***A47C 7/00*** | (2006.01) |
| ***A47B 91/04*** | (2006.01) |

(52) U.S. Cl.

CPC ..... *A47B 91/12* (2013.01); *A47B 91/024* (2013.01); *A47B 91/04* (2013.01); *A47C 7/002* (2013.01); *Y10T 29/49865* (2015.01)

(58) Field of Classification Search

CPC ... Y10T 29/49865; A47C 7/002; A47B 91/12; A47B 91/04; A47B 91/024

USPC ..... 29/447, 525.01; 264/271.1; 248/188.1

See application file for complete search history.

(56) References Cited

U.S. PATENT DOCUMENTS

| | | | |
|---|---|---|---|
| 170,190 | A | 11/1875 | Pratt |
| 887,663 | A | 5/1908 | Lee |
| 1,155,269 | A | 9/1915 | Petersen |
| 1,591,550 | A | 7/1926 | Rosenthal |
| 1,789,974 | A | 1/1931 | Grant |
| 1,843,261 | A | 2/1932 | Bales |
| 1,886,112 | A | 11/1932 | Luarde |
| 1,909,671 | A | 5/1933 | Foothorap |
| 1,917,601 | A | 7/1933 | Schermerhorn |
| 2,513,193 | A | 6/1950 | Miller |
| 2,640,219 | A | 6/1953 | Becker |

(Continued)

OTHER PUBLICATIONS

Budwig Molded Products Sales Brochure.
Rubber Edging—Customer Rubber Corps. Site Search Product Samples of Molded Rubber Bumper Bolt.

*Primary Examiner* — Sarang Afzali
*Assistant Examiner* — Darrell C Ford
(74) *Attorney, Agent, or Firm* — Buchanan Ingersoll & Rooney PC

(57) ABSTRACT

A foot for molded plastic furniture has a pad portion made of a first plastic or thermoplastic rubber and an anchor portion made of a second harder plastic or metal. The anchor has a base with a substantially flat surface that is bonded to a substantially flat top surface of the pad. Preferably the anchor portion and pad portion are co-extruded. A projection having at least one rib extends from the base of the anchor and is inserted into a cavity in a furniture leg creating a reliable mechanical fit which resists removal of the foot from the leg.

11 Claims, 8 Drawing Sheets

(56) References Cited

U.S. PATENT DOCUMENTS 2,728,166 A 12/1955 Molla
2,968,116 A 1/1961 Arenson
3,912,210 A * 10/1975 von Bohr ..... A47B 1/08 108/156
4,157,153 A * 6/1979 Barnes ..... B23K 33/006 228/136
4,549,337 A * 10/1985 Newell ..... B29C 70/78 138/96 T
5,026,010 A * 6/1991 Camarota ..... A47B 13/021 108/150
5,170,972 A 12/1992 Casals Guell
5,568,708 A 10/1996 Kassardjian et al.
D377,448 S 1/1997 Nakamura
5,878,984 A 3/1999 Grieser et al.
5,962,120 A * 10/1999 Keipert ..... B24D 3/22 428/317.5
6,045,731 A * 4/2000 Matsuoka ..... B29C 33/0044 249/91
6,076,254 A * 6/2000 Onodera ..... B23P 19/006 29/447
6,155,530 A 12/2000 Borgen
6,186,453 B1 2/2001 Redbone
6,520,459 B2 2/2003 Burr
6,623,082 B1 9/2003 Huang
7,128,494 B2 * 10/2006 Lucht ..... B60B 33/0002 248/188.1
7,401,854 B2 * 7/2008 Adams ..... A47C 1/0265 297/239
7,413,698 B2 * 8/2008 Bearse ..... B29C 44/569 156/245
D589,783 S 4/2009 Eul
7,793,386 B2 9/2010 Gianandrea
8,141,841 B2 3/2012 von Lillienskjold et al.
D661,178 S 6/2012 Adams et al.
8,205,843 B2 * 6/2012 Phillips ..... A47B 91/002 248/188.1
2005/0115022 A1 * 6/2005 Desmarais ..... A47B 91/066 16/42 R
2006/0053587 A1 * 3/2006 Chase ..... A47B 91/06 16/42 R
2006/0054755 A1 * 3/2006 Hornberger ..... A47B 91/00 248/188.9
2007/0089266 A1 * 4/2007 Beshore ..... A47B 91/06 16/42 R
2007/0226983 A1 * 10/2007 Reynolds ..... B29C 45/1704 29/447
2007/0234507 A1 10/2007 Vorpahl
2007/0262213 A1 11/2007 de Toledo et al.
2008/0060175 A1 * 3/2008 Barvosa-Carter .. A44B 18/0003 24/602
2008/0099639 A1 * 5/2008 Webster ..... A47B 91/06 248/188.9
2008/0148522 A1 6/2008 Beshore
2008/0191106 A1 8/2008 Shiffler et al.
2008/0209685 A1 9/2008 Dombroski et al.
2008/0258023 A1 * 10/2008 Desmarais ..... A47B 91/12 248/188.9
2009/0056071 A1 3/2009 Vorpahl
2010/0045084 A1 * 2/2010 Segato ..... B62J 1/007 297/195.1
2010/0171012 A1 7/2010 Tseng
2010/0230562 A1 9/2010 Fletcher et al.
2011/0198458 A1 * 8/2011 Karl ..... A47B 91/024 248/188.4
2013/0117965 A1 5/2013 Sievers
2013/0161456 A1 * 6/2013 Adams ..... A47B 91/024 248/188.9
2013/0248524 A1 * 9/2013 Goad ..... B65D 90/04 220/4.13
2014/0106099 A1 * 4/2014 Desmarais ..... A47B 91/12 428/36.1

* cited by examiner

FOOT FOR MOLDED PLASTIC FURNITURE

CROSS-REFERENCE TO RELATED APPLICATION

This is a divisional application of U.S. patent application Ser. No. 13/334,197 filed Dec. 22, 2011, now U.S. Pat. No. 9,144,309.

FIELD OF THE INVENTION

The present invention relates to injection molded plastic furniture having improved feet and methods of making such furniture.

BACKGROUND OF THE INVENTION

Injection molded plastic furniture includes chairs, tables, stools, plant stands, and many other useful forms of furniture. A major advantage of such furniture is its low manufacturing cost. Typically, such furniture is made of a thermoplastic such as polypropylene, polystyrene, polyethylene, acrylic, acrylonitrile butadiene styrene (ABS), or mixtures and combinations thereof. Fillers such as calcium or talc may also be added. The selection of which of the many commercially available plastics to use depends on a variety of design and production factors, principle among which are the strength, toughness, stiffness, and durability of the overall structure in view of the intended use of the furniture item. For economical reasons, often the furniture item is injected molded as a single piece or as a set of small number of pieces of the same plastic which are then assembled together. See for example, U.S. Pat. No. 7,401,854 B2 to Adams which discloses an injection molded stackable folding chair.

Sometimes it is useful or necessary to attach to the floor-contacting parts of the injected molded plastic furniture a separately manufactured foot. One benefit of using such a foot is to provide the article of furniture with improved friction in order to reduce the slippage of the article on smooth surfaces. Another is that, when feet are used on an article of furniture with legs such as a chair or table, the amount of internal stress the article must withstand when a load is applied is reduced. The internal stress reduction achieved by using feet can be very significant. The "ASTM Test Results" section later in this document illustrates differences in how long specific chairs hold a set weight before failing when feet are used and when they are not used. One chair held for 76 minutes with conventional feet, but only for about 1 minute with no feet. For that chair, and for many other articles of furniture, feet are a critical and integral component. Other reasons feet may be used are to cushion impacts on the furniture or to protect substrates from being scuffed by the more rigid material comprising the furniture.

Feet are usually attached to an article of furniture shortly after the injection molding of the furniture although they could also be attached sometime thereafter. The article of furniture is usually provided with a cavity or socket for receiving the anchor portion of the foot. With conventional feet, the cavity and the anchor portion are normally shaped and sized so that the foot is retained by friction. The anchor portion is designed to be slightly wider than the cavity and to be compressed into the cavity to create an interference fit (also known as a friction or press fit). In some cases, press fits create a satisfactory mechanical connection. However, they are not sufficient for connecting feet to furniture. The initial grip strength is on the low side. In addition, conventional feet are normally made of a semi-flexible material. Any semi-flexible material will take a compression set over time. So as time passes and the feet are compressed, the grip of the foot into the cavity lessens. Consequently, it is possible for frictionally retained feet to be jostled or knocked off (or to simply fall off) of the article of furniture to which they were attached. Although this conventional foot retaining method has been standard practice in the resin furniture industry for many years if not decades, it does not result in a reliable grip of the foot onto the chair. The ASTM Test Results section shows how if just one foot falls off it can cause a chair to no longer meet industry standards for outdoor furniture.

Even though semi-flexible materials take a compression set, they do not take a set as quickly as fully flexible, softer, lower-durometer materials. That is why semi-flexible materials are used for furniture feet instead of a softer material. The trade-off of not using softer foot material is that some grip on surfaces is sacrificed. Softer feet would provide more frictional grip on substrates.

The last weakness of conventional feet is the difficulty of inserting them. Since the anchor portion of the foot must be made wider than the cavity to create a friction fit, assemblers must exert themselves to squeeze the foot into the cavity. Often feet are inserted only to the point where they are stable enough to stay in place until they can be hammered fully in. Still, getting the feet even partially inserted into the cavity is difficult with conventional feet.

Another type of foot commonly used for furniture consists of a rubber washer with a bolt that passes through the center of the washer. The washer may be seated in a cylindrical metal housing to which a bolt or threaded rod is attached. Usually the head of the bolt is recessed into the washer so that only the washer makes contact with the floor. An example of such a product is available from Custom Rubber Corp., and sold as a Non-Marking Molded Rubber Leveling Foot. The leg in which the foot is attached typically has a threaded cavity or nut into which the bolt is secured. While this type of foot is securely held, several minutes may be required to install these feet on the legs of three-legged or four-legged furniture. The feet themselves are also much more expensive than feet which are extruded and friction fitted into a leg cavity.

It is also known to provide rubber caps encompassing the head of a bolt such as the Molded Rubber Bumper Bolts again made by Customer Rubber Corp. With this type of foot, there are multiple issues. First among them, the rubber must be made very hard so that it cannot slip away from the head of the bolt since soft, flexible plastic would not have adequate resistance to decoupling from the head of the bolt during use. Also, the assembly of such feet would be time consuming and/or require special receiving cavities in the furniture. Next, the cost of such feet, due to the need for a somewhat large metal bolt as a component and to the expensive nature of insert molding, is much higher than with conventional feet. Finally, such feet could come partially or fully unscrewed during use.

SUMMARY OF THE INVENTION

The present invention fills the need for a new type of foot for injection molded furniture:

a) which does not add greatly to the cost of the furniture
b) that fastens the soft pads placed at one or more locations on an article of furniture reliably enough that the pads should stay in place throughout the article's useful life c) that enables the use of a softer plastic pad than is currently possible in order to achieve a better frictional grip on substrates d) that is easier for assemblers to insert We provide a foot having an anchor portion which fits into a cavity in the leg of a chair (or to the legs or floor-contacting parts of other furniture). The anchor has a base with a substantially flat bottom surface to which a pad is attached. The pad is made of soft plastic such as flexible polyvinyl chloride and the anchor is made of a hard plastic such as rigid polyvinyl chloride. Preferably the anchor and pad are co-extruded to form a chemical bond between the hard and soft plastics. Ribs on the anchor engage and preferably deform the side wall of the cavity to create a mechanical interlock between anchor and cavity.

BRIEF DESCRIPTION OF THE DRAWINGS

The criticality of the features and merits of the present invention will be better understood by reference to the attached drawings. It is to be understood, however, that the drawings are designed for the purpose of illustration only and not as definitions of the limits of the present invention.

FIGS. 12A-12D are a series of schematic side views illustrating the insertion of a foot into a cavity similar to the cavity shown in FIG. 2, wherein:

FIG. 12A depicts the foot about to be inserted into the cavity.

FIG. 12B depicts the foot after it has been partially introduced into the cavity.

FIG. 12C depicts the foot after it has been forcibly seated fully into the cavity.

FIG. 12D depicts the foot and cavity as shown in 12A, but from a different perspective and with the cavity cross-sectioned lengthwise.

DETAILED DESCRIPTION OF PREFERRED EMBODIMENTS OF THE INVENTION

In this section, some preferred embodiments of the present invention are described in detail sufficient for one skilled in the art to practice the present invention. It is to be understood, however, that the fact that a limited number of preferred embodiments are described herein does not in any way limit the scope of the present invention as set forth in the appended claims.

Figure 1:
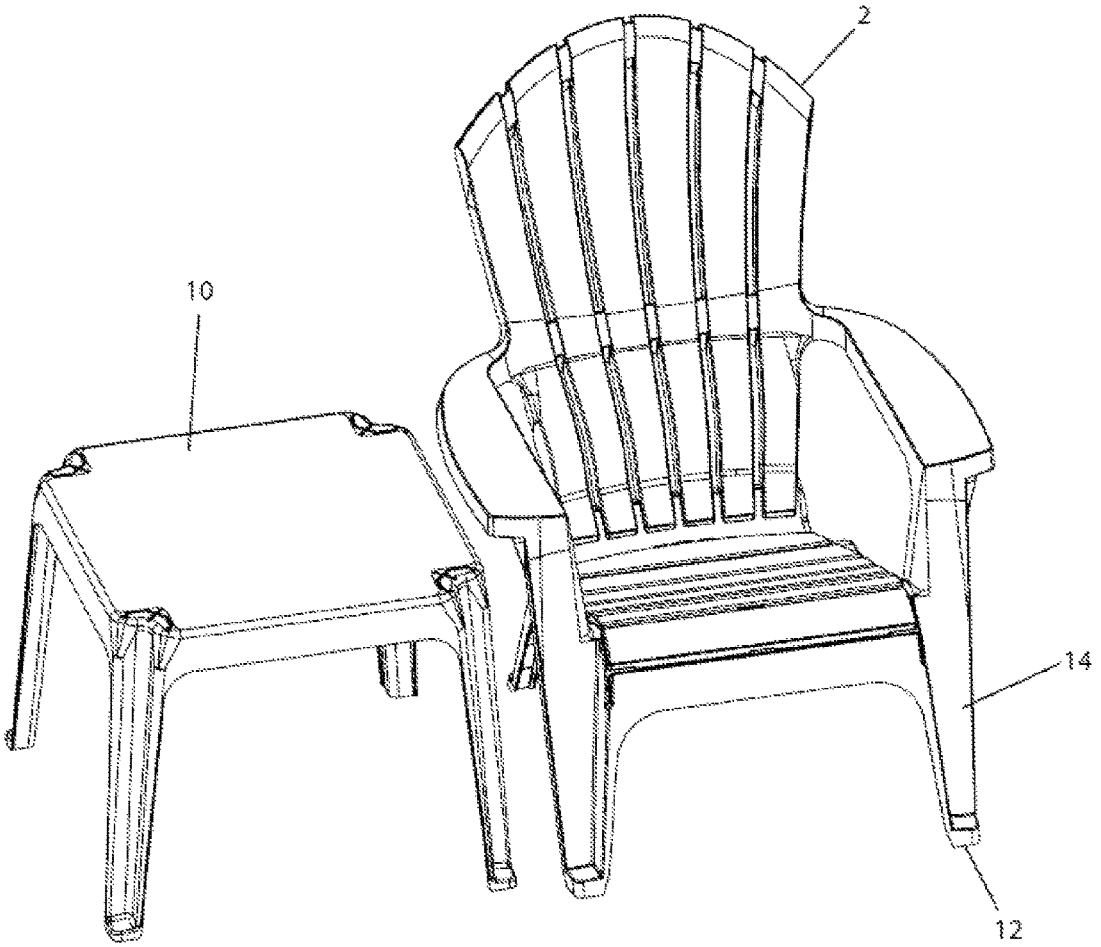
FIG. 1 is a perspective view of a chair and a table each having attached feet in accordance with an embodiment of the present invention.

Referring to FIG. 1 there is shown a chair 2 and a table 10. Each of these articles of furniture has attached to it a set of feet, e.g., foot 12, to provide the article a supporting interface with the floor upon which it sits. Although foot 12 is attached to the end of leg 14 of chair 2 or table 10, it is to be understood that the present invention may be used with all kinds of articles of furniture, e.g., chairs, tables, benches, stands, cabinets, shelves, trays, etc., regardless of whether or not the article has supporting legs, so long as at least the cavity or recess of the article of furniture by which the foot is attached has at least one wall comprising a thermoplastic as is described in more detail below. Preferably, the entire article of furniture comprises an injection molded thermoplastic. Preferably, the thermoplastic is polypropylene. Polystyrene, polyvinyl chloride, polycarbonate, polyethylene, acrylic, acrylonitrile butadiene styrene (ABS), and mixtures and combinations thereof could be used. When the thermoplastic includes polypropylene and/or polyethylene, it may include one or more fillers, e.g., calcium or talc.

Figure 2:
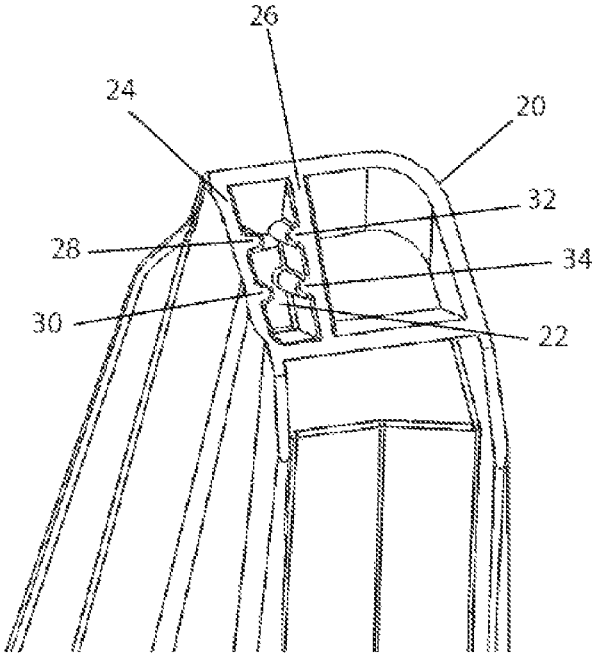
FIG. 2 is an inverted perspective view of the leg end of the chair of FIG. 1 showing a foot receiving cavity.

Referring now to FIG. 2, there is shown the bottom of a leg 20 of an article of furniture. The leg 20 has a cavity 22 for receiving a foot. The cavity 22 is defined in part by the surfaces of the first and second walls 24, 26. The first wall 24 has two ribs 28, 30 which protrude into the cavity 22 and similarly the second wall 26 has ribs 32, 34. At least one, and preferably both, of first and second walls 24, 26 is made of a thermoplastic.

Figure 3:
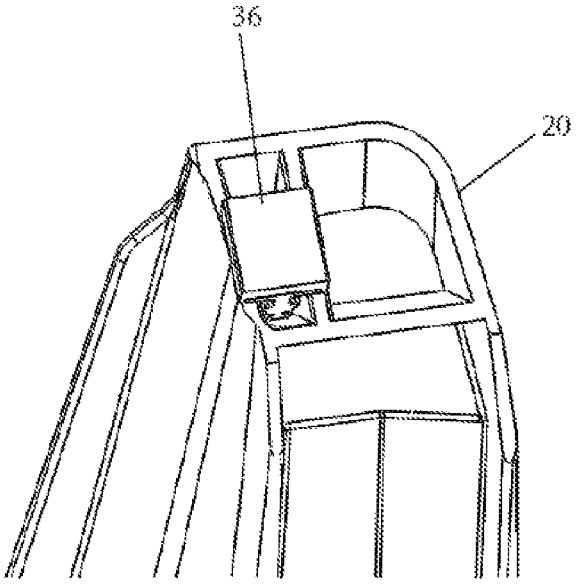
FIG. 3 is an inverted perspective view of the end of a leg of an article of furniture having a foot attached thereto in accordance with an embodiment of the present invention.

FIG. 3 shows the same leg 20 having a foot 36 fixedly attached to it. The foot 36 is better seen in FIG. 4 and FIG. 5. The foot 36 has an anchor portion 38 and a pad portion 40. The anchor portion 38 is configured to be received by the leg cavity 22. The pad portion 40 is configured to be in contact with a floor or the ground so as to at least partially support the article of furniture on the floor. The anchor portion 38 of foot 36 has a base 35 which has a substantially flat surface that is bonded to a flat surface of the pad portion 40 along junction 42. A projection 37 extends upward from the base. Ribs 39 are provided on the outer surface of this projection 37.

The anchor portion 38 and the pad portion 40 join along junction 42. The anchor portion 38 comprises a set of two pairs of opposing self-centering surfaces 44, 48 which act to center the anchor portion 38 as the foot 36 is being inserted into the leg cavity 22. The anchor portion also has two pairs of opposing alignment surfaces 50, 52 which act to assist in the alignment of the anchor portion 38 within the leg cavity 22. The alignment surfaces 50, 52 are designed to be only slightly wider than the leg cavity 22 so that the foot 36 can be easily inserted by hand until the opposing wedging surfaces 54 stop the penetration at which point the foot 36 is held steadily enough by friction in the cavity 22 in a partially-inserted position (see FIG. 12B) to be hammered in to a fully-inserted position without the need for the assemblers to try to stabilize the foot 36 with their fingers while making the hammer blow. With conventional feet, the top of the anchor is much wider which makes partial insertion of the foot much more difficult. The anchor portion also has a pair of opposing groove-forming surfaces 56 and a pair of opposing retention surfaces 58 which, along with the wedging surfaces 54, interact to form an indentation in the first and second walls 24, 26 of leg cavity 22 (see reference numbers 168, 170 of FIG. 12C) in a manner which is described below. The anchor portion 38 also has a pair of limiting surfaces 60 which act to limit the depth to which the anchor portion 38 can be forced into the leg cavity 22. The anchor portion 38 also has two opposing neck regions 62, 64 which, while providing continuity between the other features of the foot 36 which are adjacent to them, also reduce the amount of material needed to make the foot 36.

Figure 4:
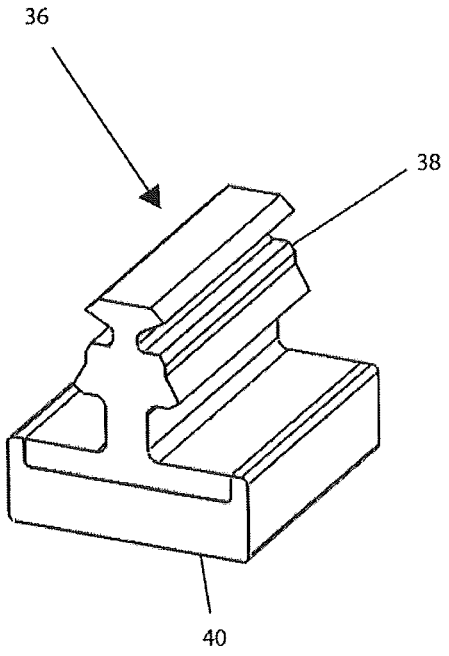
FIG. 4 is a perspective view of the foot that is depicted in FIG. 3.
Figure 5:
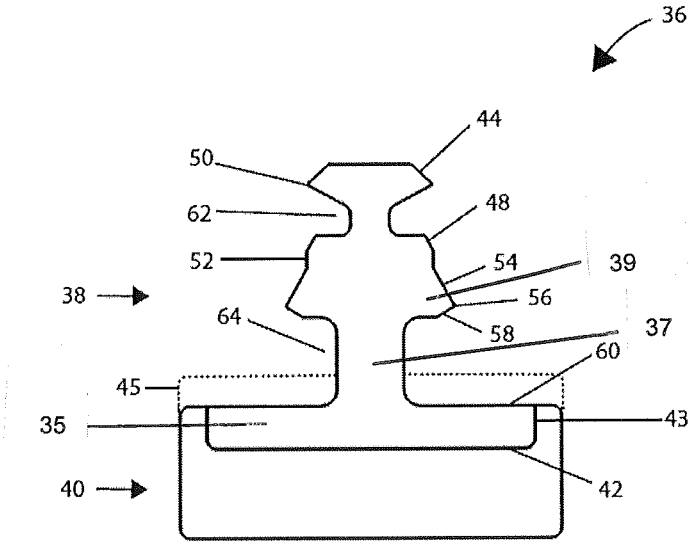
FIG. 5 is an end view of the foot shown in FIGS. 3 and 4.
Figure 5A:
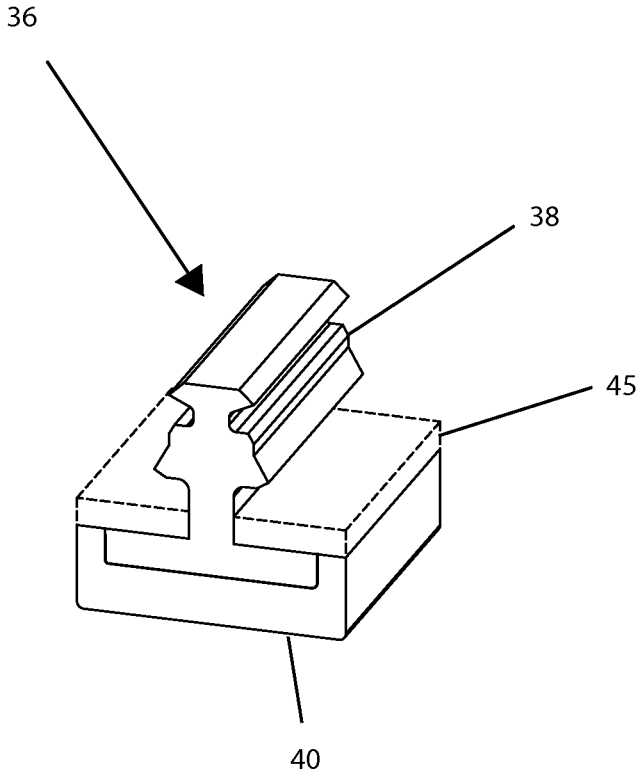
FIG. 5*a* is a perspective view of the foot shown in FIG. 5
Figure 6:
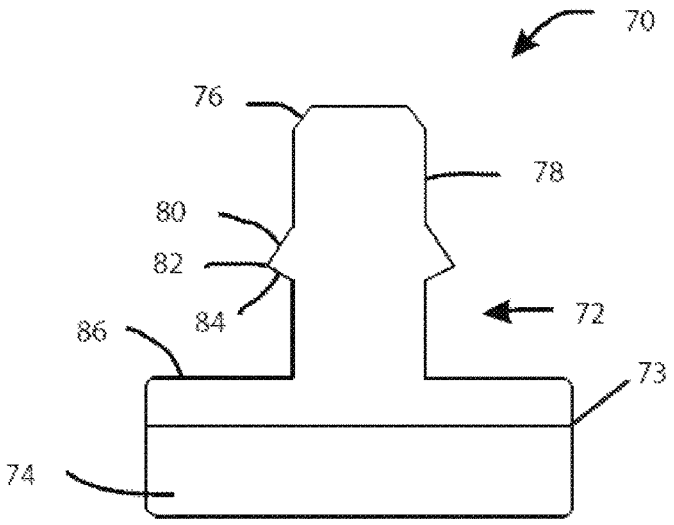
FIG. 6 is an end view of a foot according to another embodiment of the present invention.

The horizontal junction 42 between the anchor portion 38 and pad portion 40 should be flat or slightly curved or rippled such that the surface area of the pad which contacts the anchor portion is at least 75% and preferably over 90% of the area of the bottom surface of the pad. Because the pad is preferably made of a material that is softer than the anchor, tearing of the pad may occur if the contact surface of the pad portion with the anchor portion is less than 75% of the area of the bottom surface of the pad. This tearing can occur if the feet are on a chair or other article which is slid or "scooched" across the floor or on any other article which must withstand lateral forces. To further improve the strength of the attachment between anchor and pad, the pad may extend up the edges of the anchor portion as shown in FIGS. 4 and 5 to create a vertical junction 43. The vertical junction 43 is intended to prevent separation of the anchor and pad from starting along the sides of or at the corners of the horizontal interface 73 of the anchor portion as shown in FIG. 6. The pad extension 45 in dotted lines in FIG. 5 shows how the pad could be further extended to wrap over the limiting surface 60 of the anchor.

Figure 7:
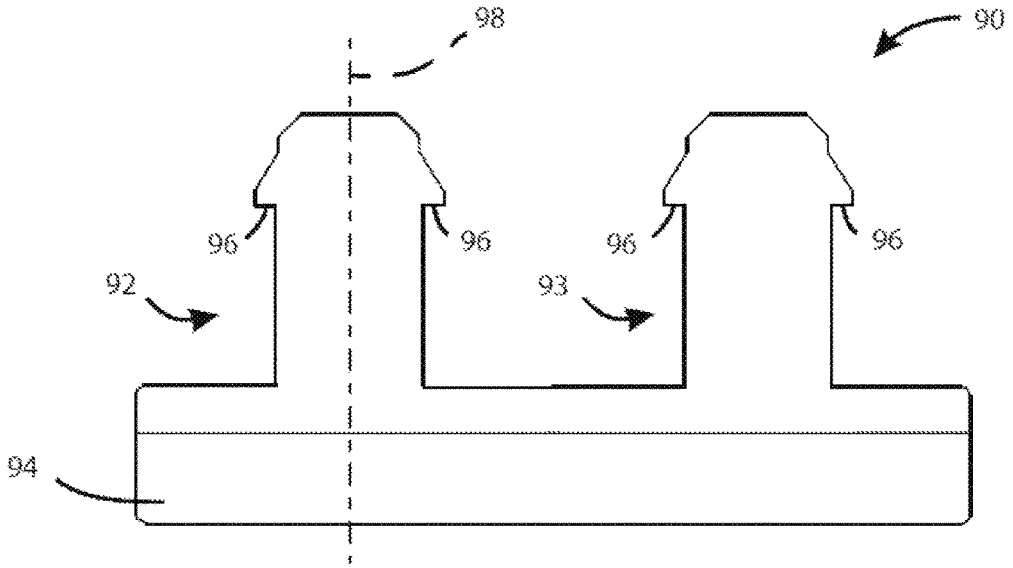
FIG. 7 is an end view of a foot according to yet another embodiment of the present invention where the foot is wider and has multiple anchor portions.
Figure 8:
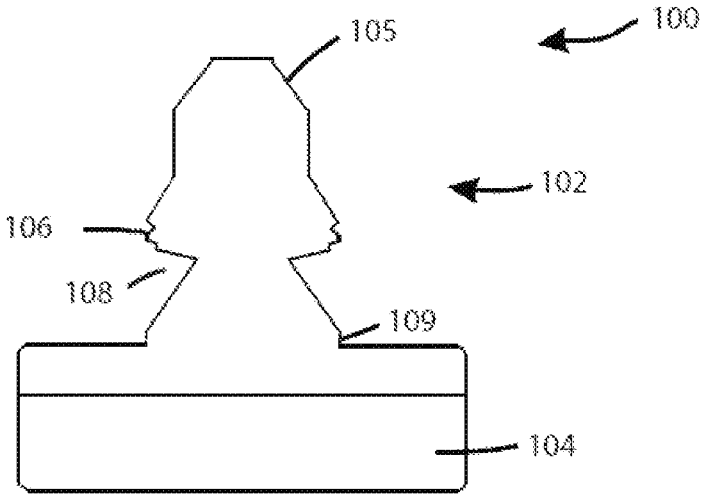
FIG. 8 is an end view of a foot according to still another embodiment of the present invention.

It is to be understood that the foot 36 shown in FIGS. 4 and 5 is according to a particularly preferred embodiment of the present invention. Examples of some of the numerous additional embodiments of feet in accordance with the present invention are shown in FIGS. 6-8. Referring first to FIG. 6, there is shown a foot 70 which has anchor portion 72 and pad portion 74. The anchor portion 72 has a pair of opposing self-centering surfaces 76, a pair of opposing alignment surfaces 78, a pair of opposing wedging surfaces 80, a pair of opposing retention surfaces 84, and a pair of limiting surfaces 86. Surfaces 80 and 84 meet at groove-forming surface 82 to form ribs along the sides of the anchor (and which could run around the ends of the anchor as well if the feet were co-injection molded rather than co-extruded).

Referring now to FIG. 7, there is shown a foot 90 having two anchor portions 92 and 93 and a pad portion 94. The foot 90 is similar to the foot 70 of FIG. 6, with the following exceptions. The foot is wider and longer. In the drawings, particularly FIG. 3, we have illustrated the foot to be smaller than the end of the leg to which the foot is attached. However, the foot can be larger such that there is more contact area between the foot and the floor. Greater contact area may increase skid resistance which may be desirable for larger chairs or tables, it would also distribute higher potential loads over more floor or ground area, and it can also create more foot stability or resistance to leg twisting. However, in these instances larger feet may have to withstand more stress such that the multiple anchor portions 92 and 93 may be needed to handle that increased stress without the foot cracking. The four retention surfaces 96 of foot 90 are disposed perpendicularly to the longitudinal midplane 98 of the anchor 92 (and/or the second anchor 93 as the anchors are parallel) and the ribs are flattened. Also, the retention surfaces 96 are positioned higher on the anchor to form the mechanical interlock deeper in the foot cavity. This would result in more plastic in the ribs 28, 30, 32, 34 under the retention surfaces 96 which may increase the grip of the foot 90 into the cavity although further empirical testing of the revised design would be needed to confirm that is indeed the case.

Referring now to FIG. 8, there is shown a foot 100 having an anchor portion 102 and a pad portion 104. The foot 100 is similar to the foot 70 of FIG. 6, except that its groove-forming surface 106 has an irregular shape and it also has a neck 108. Thus, the edge of the ribs can have a knife edge shape shown in FIG. 6, be flattened as in FIG. 7 or have an irregular shape as in FIG. 8. Any shape that is useful for making the indention in the manner described below can be used. Two other features of the foot 100 are noteworthy. The self-centering surfaces 105 are more pronounced for easier hand loading. This feature may (or may not) be necessary if the foot insertion process were automated depending on if an easier lead-in were required. The anchor stabilizer 109 could be used to prevent wobble or transverse rotation of the foot in the cavity.

Figure 9:
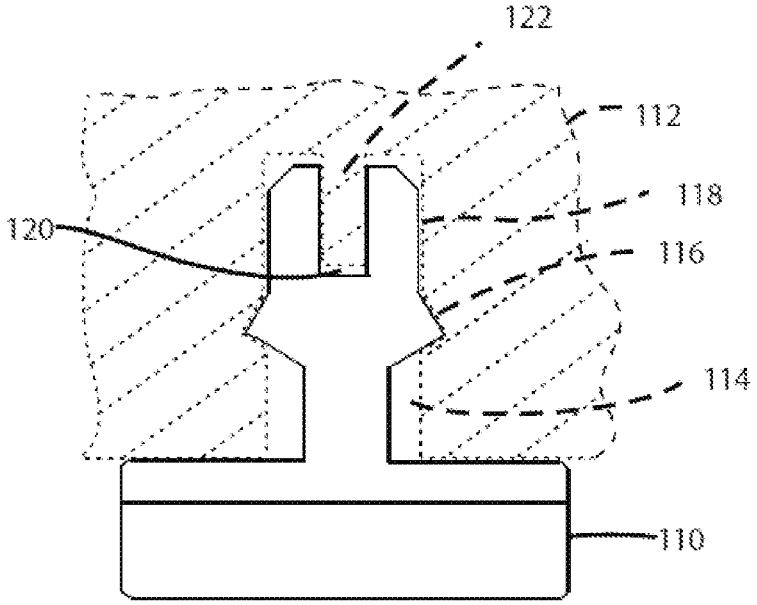
FIG. 9 is an end view of a foot according to another embodiment of the present invention with a section of the article of furniture shown in ghost lines.

Referring now to FIG. 9, there is shown a foot 110 in accordance with another embodiment of the present invention. The foot 110 is shown attached to the article of furniture 112 (which is shown in ghosted lines) within cavity 114 of the article of furniture 112. Note that the foot 110 has formed indentations, e.g., indentation 116, in what was a flat surface of the walls 118 of the article of furniture 112 prior to the forced insertion of foot 110 into cavity 114. Also note that in this embodiment of the present invention, the foot 110 has an inset 120 for receiving a protrusion 122 from an end wall of the cavity 114.

Figure 10:
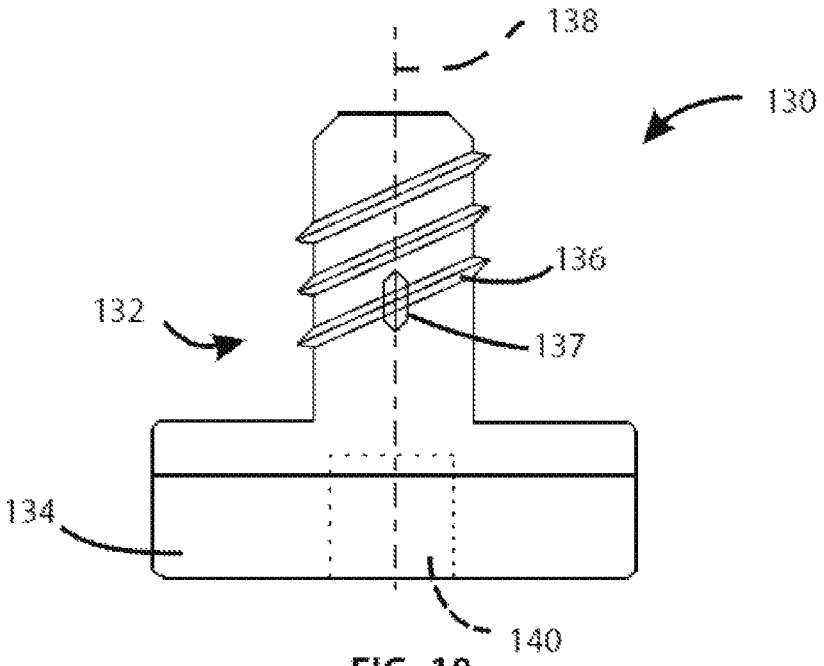
FIG. 10 is a side view of a foot having helical threads according to another embodiment of the present invention.
Figure 11:
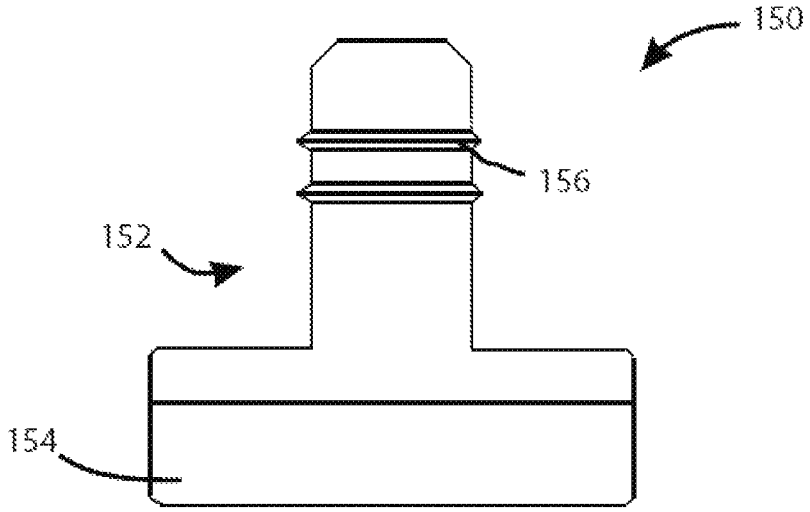
FIG. 11 is a side view of a foot having annular threads according to another embodiment of the present invention.

Two more embodiments of feet in accordance with the present invention are depicted schematically in FIGS. 10 and 11. Referring now to FIG. 10, there is shown a foot 130 having an anchor portion 132 and a pad portion 134. The anchor portion 132 can have a circular cross-section and has helical threads 136 which form a helical indentation into the wall of the receiving cavity of the article of furniture when it is forcibly inserted into the cavity while being rotated about its longitudinal axis 138. The foot 130 also has a recess 140 for receiving a tool for rotatably driving the foot 130 into the article of furniture cavity. Additionally, or alternatively, the outside edges of the pad portion 134 and/or the outside edges of the anchor portion 132 may be configured to be received within a tool for rotatably driving the foot 130 into the receiving cavity of the article of furniture. To prevent the threads from starting to unscrew, a vertical catch 137 could be added in one or more locations on the helical threads 136.

Referring now to FIG. 11, there is shown a foot 150 having an anchor portion 152 and a pad portion 154. The anchor portion 152 has annular threads 156 which form circular or arc-like indentations into the wall surface of the receiving cavity of the article of furniture when it is forcibly inserted into the cavity.

The anchor portion and pad portion of a foot according the present invention are most likely to be made of thermoplastics, although it would be possible to have the anchor portion be made of metal. When the anchor portion is made of a thermoplastic, it may be made of one that is the same as or different from the pad portion. In the context of this patent application, two thermoplastics are to be construed as being different if they have different chemical or physical properties. For example, an anchor portion that is made of a hard PVC that has a durometer hardness of 74 on the Shore D scale and a pad portion that is made of a soft PVC that has a durometer hardness of 60 on the Shore A scale are to be construed as being made of different thermoplastics. In embodiments wherein the anchor portion and the pad portion of a foot are made of different thermoplastics, these portions may be joined together by any means known in the art which will provide a bond strong enough to keep the portions from separating during use. Co-injection molding, insert molding, or other bonding methods known in the art may be used. Most preferably, the portions are made from materials which are chemically compatible and chemically bond during co-extrusion.

The anchor portion is harder than the pad portion. The anchor portion thermoplastic is selected to have sufficient hardness and rigidity to enable the anchor portion to form the indentations in the manner described below. Preferably, the anchor portion is polyvinyl chloride having a durometer hardness of at least 70 on the Shore D scale. However, depending on the material used to make the furniture, the material used for the anchor portion may need to be made harder than 70 Shore D. This may require the use of ABS, nylon, filled polypropylene, polycarbonate, or another very hard thermoplastic, or possibly even metal. The pad portion thermoplastic is selected to have sufficient strength for at least partly supporting the article of furniture and operationally suitable abrasion resistance and friction properties with respect to its surface that is designed to contact the floor. Preferably, the pad portion material will be selected from one of the following types of thermoplastics: polyvinyl chloride (PVC), thermoplastic elastomer (TPE), polyurethane, real or thermoplastic rubber, silicone, and mixtures and combinations thereof. If using a metal anchor, a special metal-bonding plastic such as a TPV would be required. Preferably, the pad portion thermoplastic is a PVC that has a durometer hardness of no more than about 65 on the Shore A scale.

The shape the foot is to have can influence the process chosen to manufacture the foot. For example, feet having elongate shapes, such as the foot 36 shown in FIG. 4, are well suited to being made by an extrusion process. In contrast, feet wherein the anchor portion has a longitudinal axis and shape in a cross-sectional plane that is perpendicular to its longitudinal axis that is a circle, an oval, or a regular or irregular polygon, especially when the anchor portion also has annular or helical threads, are suited to being made by a co-injection molding process.

Figure 12A:
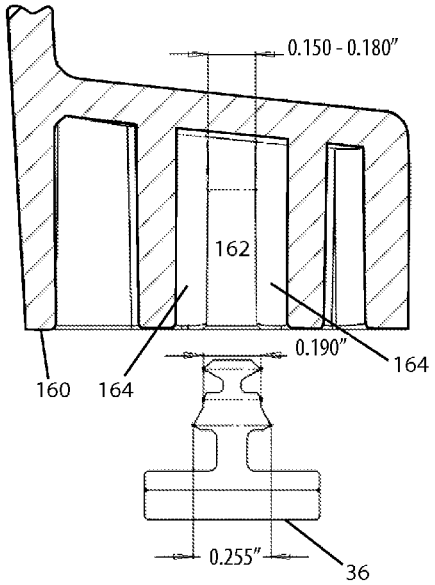

Some preferred methods of attaching feet to articles of furniture according to embodiments of the present invention will now be described with reference to FIGS. 12A to 12D. FIGS. 12A and 12D schematically show a foot 36 (similar to the one shown in FIGS. 3-5) positioned below a portion of an article of furniture 160 (shown in cross-section). The article of furniture 160 has a cavity 162 which is adapted for receiving the foot 36. We prefer to provide ribs 164 which extend into the cavity and are engaged by the anchor portion of the foot. In FIG. 12A we provided a range for the preferred distance between the ribs 164 as well as the preferred widths of the anchor portion at the alignment surfaces 50, 52 and opposing groove-forming surfaces 56.

Figure 12B:
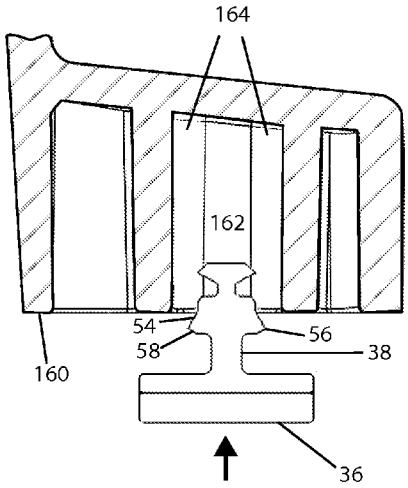

FIG. 12B shows the foot 36 after it has been initially seated in the cavity 162. In the initial seating a part of the foot anchor portion 38 has been introduced into the cavity 162 to where the wedging surfaces 54 are resting against the ribs 164. The section of the anchor portion 38 of foot 36 that is within cavity 162 is sized so that the foot can be placed in the cavity manually with little effort. This is an improvement over prior art feet that required a substantial amount of force to be initially seated. Preferably, the foot anchor portion 38 is dimensioned so that it makes an interference fit with the cavity 162 up to its wedging surfaces 54 so that it initially seats with just a light push and is retained within the cavity 162 even if jostled.

Figure 12C:
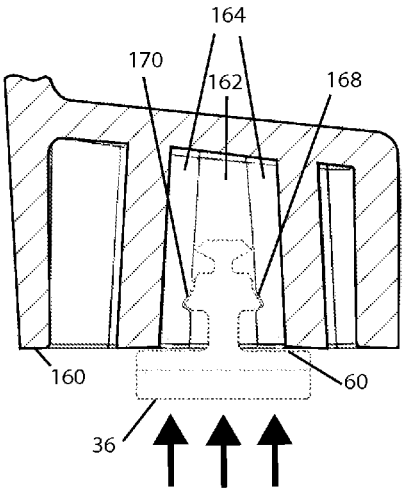
Figure 12D:
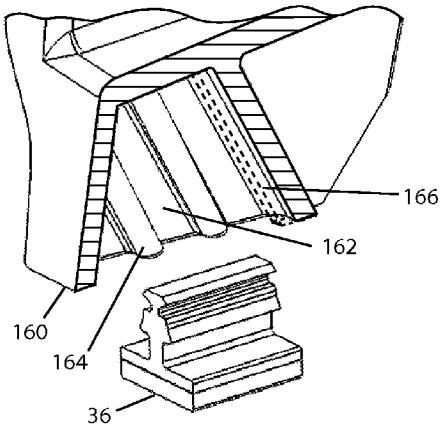

When the foot is positioned as in FIG. 12B the foot is hit with a hammer or mallet for final insertion as shown in FIG. 12C. The application of a substantially greater force to foot 36 forces the anchor portion 38 down deeper into the cavity 162 until further progress is stopped by the contact of the limiting surfaces 60 of the anchor portion 38. As the downward movement occurred, the wedging surfaces 54 locally elastically forced apart the ribs 164 sufficiently to permit the downward movement of the anchor portion 38 into the cavity 162. After the movement substantially ended, the wedging surfaces 54, the grooving surfaces 56, and the retention surfaces 58 of foot 36 cooperate to form permanent indentations 168, 170 into the surfaces of the ribs 164. These indents are formed by plastic deformation of the ribs 164 as the cavity exerts sufficient compressive strength as it resists spreading to groove the ribs 164 around the anchor. Preferably the foot is inserted into the leg immediately after the furniture is molded. At that time the cavity ribs 164 will not have fully hardened, and as a result they will deform more easily around the ribs on the anchor. The deformation of the ribs 164 occurs over the course of a time period of up to an hour long. The indentations 168, 170 of the cavity 162 and at least the retention surfaces 58 of the foot 36 cooperate to form an interlocking joint which opposes the removal of the foot 36 from the article of furniture. Consequently, the foot disclosed herein, inserted in the manner here described will not fall out during normal handling and use of the furniture to which the foot is attached. We prefer to provide ribs that extend into the cavity and are engaged by the anchor. However, one could omit the ribs and size the cavity so that the anchor bites into the sidewalls that define the cavity. Alternatively, one could provide fins 166 on one or both ends of the cavity that may act as lead-ins for the foot so that the foot is centered or otherwise specifically located within the length of the cavity.

The walls 24, 26 of the cavity in FIG. 2 are distorted slightly outward during the foot insertion process described above. Thus the anchor stabilizer 109 of FIG. 8 would be made slightly wider than the original distance between the ribs 164 to more completely fill the larger gap that would exist at the bottom of the cavity. This would be for specific foot applications where there are more severe than normal loads in the transverse direction.

Most resin molded chairs which have foot pads rely on those pads to provide proper performance and stability. When one or more pads fall out of a chair the integrity and stability of the chair is compromised. The present invention essentially eliminates the risks involved with pads falling out.

When we prefer to use the insertion technique described in the discussion of FIGS. 12A-12D that technique need not be used where the anchor has a circular cross-section. In those embodiments, the foot is rotated around its longitudinal axis as it is forced into the receiving cavity in the article of furniture. This technique is especially useful when the foot has helical threads, e.g., like foot 130 shown in FIG. 10.

Molded plastic articles usually shrink to some extent immediately after the article is extruded or removed from a mold. The amount of shrinkage will depend upon the type and amount of plastic used. Inserting the foot immediately after the article is removed from the mold takes advantage of this shrinkage. The walls of the cavity will shrink around the anchor portion of the foot to tighten the grip of the cavity onto the foot, working in conjunction with the compressional force exerted by the cavity walls to create a reliable mechanical interlock.

The foot here disclosed has several advantages of other feet that have been used on furniture. First, the foot here disclosed can be made at a significantly lower cost than the non-marking molded rubber leveling feet that use a bolt and washer or similar structure. A foot configured as in FIGS. 4 and 6 can be made for around one cent ($0.01) while one can expect to pay at least a few cents for each non-marking molded rubber leveling foot.

Another advantage of the foot here disclosed is ease of installation. One can install a foot into a chair leg in a matter of seconds. No special equipment or tools, other than a hammer or mallet, is needed.

The foot disclosed can be used in any type of Mono-Block Resin Furniture, regardless of the line of draw on the ribs in the foot cavities. This fact is especially used for Adirondack chairs where the line of draw on the rear and/or front legs creates ribs with very pronounced angles from vertical. Unlike the screw/bolt of prior-art designs the foot here disclosed can be installed into cavities/ribs/sockets formed by any angle of mold draw.

The pad portion of the foot can be made from 60 durometer (Shore A) material, which improves the performance of molded plastic chairs. That improvement is described below in the context of the test results discussed herein. One cannot use 60 durometer material for a washer in a bolt and washer type foot because the bolt would tear the washer when the foot is subjected to lateral forces, such as when a chair is slid across the floor. Tearing may expose the hard metal bolt which can scratch the floor. The hard metal bolt could also be exposed if the pad abraded away. Such a soft washer may also fold over onto itself during installation.

Although it is preferable that the entire article of furniture is made of a thermoplastic and be injection molded, the present invention is not limited to such furniture. Rather, the present invention encompasses all furniture, regardless of whether or not it has been injection molded in whole or in part, which have a receiving cavity for a foot in which the cavity is defined in part by a thermoplastic wall upon which the foot can act upon insertion to form an indention in the manner described above.

Other advantages of the current invention are illustrated in the sections below.

Pull Force Test Results

Injection molded chairs made of polypropylene were provided with cavities for receiving supporting feet. The cavities had walls with surfaces which were free of indentations. Feet having the design shown in FIG. 6 were made having an anchor portion comprising rigid PVC having a durometer Shore D hardness of 74 and a pad portion comprising flexible PVC having a durometer Shore A hardness of 60 by coextrusion. The temperatures of the walls of the receiving cavities were adjusted to temperatures within the range of from about 175° F. to about 250° F. and the feet were forced into the cavities in the manner described above with reference to FIGS. 12A to 12D. The axially directed force required to remove the feet was measured using a testing rig that had a maximum pull force of 44 pounds force. The test was repeated in another rig applying 60 pounds of force. None of the feet were able to be removed by the testing rigs. The feet were subsequently removed by prying them out so that the cavity walls could be examined. The examination revealed indentations in the wall surfaces corresponding to the ribs on the anchor portion of the feet.

For comparison, conventional feet made of a single material, a semi-flexible PVC having a durometer Shore A hardness of 88, were inserted into the receiving cavities of similar injection molded polypropylene chairs. The force required to remove these conventional feet was measured using the same testing method and rig to be less than 4 pounds force. The cavities were inspected after the feet had been removed and found to be free of indentations.

Although the pull force results shown above illustrate the dramatic increase in the grip strength of foot into cavity, other superior configurations potentially exist. Various features of the cavity, such as wall thicknesses, rib heights, and cavity length, width, and height, could be modified. Alternatively, the feet could also be adjusted to achieve the same relative dimensions as if adjusting the cavity. The end-result of such modifications might be even better pull force results. On the other hand, it may be determined that the grip strength of foot to cavity is greater than is necessary for a particular article of furniture. In which case, the anchor portion could for example be made narrower if that would allow for full hand insertion of the feet here disclosed while still providing adequate foot grip and retention.

ASTM Test Results

Plastic chairs for outdoor use must meet certain standard performance requirements. ASTM F 1561-03 standard sets forth specific tests to be performed in order to determine if a plastic chair meets those requirements. One test involves placing the chair on a glass surface which simulates smooth surfaces such as linoleum and wet pool decks. Three hundred pounds is placed on the chair. The chair must then hold for at least 30 minutes without failing. Failure occurs when the chair collapses or when any visible evidence of structural damage develops such as cracking. Chairs are often left up beyond 30 minutes to further evaluate performance even though that is not specified as necessary per the ASTM standard.

Testing was conducted on three types of plastic molded chairs sold by Adams Mfg. of Portersville, Pa.: an Adirondack chair sold under the ERGO ADIRONDACK® brand, a regular Adirondack chair, and a low back chair. All three chairs were tested under four conditions when placed on a glass surface and carrying a 300 pound weight according to ASTM F 1561-03. First the chairs were equipped with feet configured as in FIGS. 12A-D. Second, the chairs were tested with all four molded plastic feet of the type that were used prior in the prior art. Those feet are T-shaped and made of 88 durometer Shore A polyvinyl chloride. Then the chairs were tested with three of those conventional feet, one foot having been removed. Finally the chairs were tested without any feet simulating a condition where all feet had fallen out of the chair. Since the feet here disclosed are very unlikely to come out of the legs no testing was done with three or fewer feet of the type here disclosed. Table 1 reports the minutes to failure for these chairs under those four conditions. Table 2 reports the percentage decrease in holding time versus the holding time achieved with the feet herein disclosed.

TABLE 1

| | Minutes to Failure | | | |
|---|---|---|---|---|
| | Feet Here Disclosed | 4 Conventional Feet | 3 Conventional Feet | No Feet |
| Ergo Adirondack ® | 369 | 331 | 127 | 31 |
| Adirondack | 82 | 71 | 25 | 21 |
| Low Back | 78 | 76 | 41 | 1 |

TABLE 2

| % Decrease in Time to Failure (vs. Feet Here Disclosed) | | | |
|---|---|---|---|
| | 4 Conventional Feet | 3 Conventional Feet | No Feet |
| Ergo Adirondack ® | 10% | 66% | 92% |
| Adirondack | 13% | 70% | 74% |
| Low Back | 3% | 47% | 99% |

Table 1 shows the chairs with the new feet performed better than those with conventional feet. We attribute the improvement to the use of softer durometer material for the surface of the foot which contacts the floor. The softer material has better frictional properties. Prior to the present invention such soft materials could not be used because of tearing or inability to insure the soft material into a cavity in a chair leg without folding or distorting the materials. As Table 2 shows, the use of conventional feet results in hold time decreases of 10% and 13% for the two types of Adirondack chairs. Using conventional feet with the Low Back chair only resulted in a decrease of about 3% in hold time, but still the chairs with conventional feet had inferior performance.

Since conventional feet can and do fall out of a chair leg, the more important comparison is with failure times for chairs with 3 conventional feet and no feet. There are massive decreases in holding time when just one conventional foot has been removed. With one foot missing, the chairs tested lost anywhere from 47% to 70% of their holding strength.

Because failure time in this ASTM test is a predictor of failure of a chair during use, the feet disclosed here provide a much safer plastic chair.

Another thing this testing brings to light is that chairs that do not have the securely locked-in feet here disclosed can only be said to be able to pass the 30-minute ASTM requirement with the caveat "as long as none of the feet have fallen out". The Adams Mfg. regular Adirondack chair tested, which held over twice as long as the ASTM standard dictates when all four feet were intact, did not pass the test with one conventional foot missing. Chairs that were made by competitors of Adams Mfg. were purchased at various retail locations and were also tested. A foot was easily removed from one such chair and that chair only held for 11 minutes before failing.

ASTM standards for outdoor furniture could in the future be updated to include a "pull force test" such as described in the previous section. The test might require that feet be able to withstand a minimum axially directed force of such as 45 lbs. or 60 lbs. without releasing from the cavity. It could stipulate that if the feet are unable to withstand that force, then, for a chair to be deemed as acceptable, all the feet would need to be removed before the chair is tested. This would reduce the occurrence and risk of consumers getting chairs with one or more missing feet which, as a result, do not meet ASTM's standard that chairs must hold 300 lbs. on glass for at least 30 minutes.

While we have disclosed certain present preferred embodiments of our feet for molded plastic furniture, furniture containing those feet and a method of installing those feet, it should be distinctly understood that our invention is not limited therefore but may be variously embodied within the scope of the following claims.

What is claimed is:

1. A method for inserting an article into a cavity in molded plastic furniture, the cavity defined by a plurality of sidewalls comprised of a first sidewall positioned opposite a second sidewall, the sidewalls comprised of a first plastic having a first hardness and the article having a body and an anchor portion attached to the body, the anchor portion made of one of a second plastic and a metal having a second hardness which is harder than the first hardness, the anchor portion comprised of a base, a projection extending from the base and having an outer surface that defines a cross-sectional shape of the projection; and a plurality of wedging surfaces on the outer surface of the projection, the method comprising:

forming molded plastic furniture by a molding process such that the molded plastic furniture defines the cavity and the first sidewall and the second sidewall of the cavity;

positioning the anchor portion adjacent the cavity before the sidewalls have fully hardened after the molded plastic furniture has been released from a mold used to make molded plastic furniture;

applying a force to the anchor portion to cause the anchor portion to move into the cavity, the cavity and the wedging surfaces being sized and positioned so that as the anchor portion moves into the cavity the wedging surfaces cause the first sidewall and the second sidewall to be forced apart from one another to permit movement of the anchor portion into the cavity; and removing the force from the anchor portion, such that after the force is removed the wedging surfaces will have formed permanent indentations in the first sidewall and the second sidewall.

2. The method of claim 1 also comprising forming at least one rib on each of the first sidewall and the second sidewall such that the wedging surfaces form permanent indentations in the ribs after the force has been removed from the anchor portion.

3. The method of claim 2 wherein there are a pair of ribs on each of the first sidewall and the second sidewall.

4. The method of claim 3 wherein the cross-sectional shape of the projection is rectangular.

5. The method of claim 2 wherein the projection is cylindrical and the at least one rib is at least one thread.

6. The method of claim 1 wherein the force is applied to the anchor portion by hammering the body to which the anchor portion is attached.

7. The method of claim 1 wherein the anchor portion has a Shore D durometer of at least 74.

8. The method of claim 1 wherein a cross-section of the projection is a polygon, a circle or an oval.

9. The method of claim 1 wherein the body is comprised of a pad having a hardness which is less than the hardness of the anchor portion.

10. The method of claim 1 wherein the anchor portion and the body were formed by co-extrusion of the body and the anchor portion.

11. The method of claim 1 wherein the anchor portion is made of a plastic selected from the group of plastics consisting of polyvinyl chloride, nylon, filled polypropylene, acrylonitrile butadiene styrene, polycarbonate, mixtures thereof or combinations thereof.

* * * * *